US011117777B2

(12) United States Patent
Ikeda

(10) Patent No.: US 11,117,777 B2
(45) Date of Patent: Sep. 14, 2021

(54) SHEET CONVEYOR DEVICE AND IMAGE FORMING SYSTEM

(71) Applicant: KYOCERA Document Solutions Inc., Osaka (JP)

(72) Inventor: Yuta Ikeda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 345 days.

(21) Appl. No.: 16/435,644

(22) Filed: Jun. 10, 2019

(65) Prior Publication Data

US 2019/0375607 A1 Dec. 12, 2019

(30) Foreign Application Priority Data

Jun. 12, 2018 (JP) ..... JP2018-111831

(51) Int. Cl.

| | |
|---|---|
| ***B65H 43/00*** | (2006.01) |
| ***B65H 29/14*** | (2006.01) |
| ***G03G 15/00*** | (2006.01) |
| ***G03G 21/16*** | (2006.01) |

(52) U.S. Cl.

CPC ..... *B65H 43/00* (2013.01); *B65H 29/14* (2013.01); *G03G 15/6529* (2013.01); *G03G 21/16* (2013.01); *G03G 21/1642* (2013.01)

(58) Field of Classification Search

None

See application file for complete search history.

(56) References Cited

U.S. PATENT DOCUMENTS

| | | | | |
|---|---|---|---|---|
| 7,175,173 | B2 * | 2/2007 | Anzai | B65H 5/34 270/58.01 |
| 2005/0121847 | A1 * | 6/2005 | Anzai | G03G 15/6529 270/58.08 |
| 2020/0285184 | A1 * | 9/2020 | Hitaka | G03G 15/55 |

FOREIGN PATENT DOCUMENTS

JP 2001-027871 A 1/2001

* cited by examiner

*Primary Examiner* — Leslie A Nicholson, III

(74) *Attorney, Agent, or Firm* — Studebaker & Brackett PC

(57) ABSTRACT

A sheet conveyor device is to be attachably and detachably mounted to an external apparatus which forms an image on a sheet. The sheet conveyor device includes a judgement section, a speed determining section, and a conveyance controller. The judgement section determines which of a plurality of model groups the external apparatus belongs to based on specification information indicating specifications of the external apparatus. The speed determining section determines a conveyance speed at which the sheet is to be conveyed based on the determined model group. The conveyance controller directs conveyance of the sheet at the determined conveyance speed.

11 Claims, 5 Drawing Sheets

400

| 401 Model group | 402 Sheet size | 403 Printing capability [sheets/minute] | 404 Linear speed [mm/s] | 405 Conveyance speed [mm/s] |
|---|---|---|---|---|
| High-end | A3,B4<br>A4, B5<br>Postcard | 40～60 | 200～300 | 600 |
| Low-end | B4<br>A4,B5 | 25～32 | 125～160 | 300 |

400

| 401 Model group | 402 Sheet size | 403 Printing capability [sheets/minute] | 404 Linear speed [mm/s] | 405 Conveyance speed [mm/s] |
|---|---|---|---|---|
| High-end | A3,B4<br>A4, B5<br>Postcard | 40～60 | 200～300 | 600 |
| Low-end | B4<br>A4,B5 | 25～32 | 125～160 | 300 |

FIG. 4

SHEET CONVEYOR DEVICE AND IMAGE FORMING SYSTEM

INCORPORATION BY REFERENCE

The present application claims priority under 35 U.S.C. § 119 to Japanese Patent Application No. 2018-111831, filed on Jun. 12, 2018. The contents of this application are incorporated herein by reference in their entirety.

BACKGROUND

The present disclosure relates to a sheet conveyor device and an image forming system.

A technique has been studied by which sheets are conveyed at different speeds according to an image forming process in order to attempt to shorten a first copy time or a first print time of an image forming apparatus.

Some image forming apparatuses are adapted to attachment thereto of an optional post-processing device. The post-processing device performs post-processing such as punching or stapling of a sheet on which an image has been formed. A sheet conveyor device (relay unit) which relays conveyance of the sheet between axe image forming apparatus and the post-processing device is also produced.

SUMMARY

A sheet conveyor device according to an aspect of the present disclosure is to be attachably and detachably mounted to an external apparatus which forms an image on a sheet. The sheet conveyor device includes a judgement section and a speed determining section. The judgement section determines which of a plurality of model groups the external apparatus belongs to based on specification information indicating specifications of the external apparatus. The speed determining section determines a conveyance speed at which the sheet is to be conveyed based on the determined model group.

An image forming system according to an aspect of the present disclosure includes an image forming apparatus and a sheet conveyor device. The image forming apparatus includes an image forming section and a paper ejection section. The image forming section forms an image on a sheet. The paper ejection section includes an empty space in which the sheet with the image formed thereon is housable. The empty space is open towards an outside of the image forming apparatus. The sheet conveyor device is mounted to the paper ejection section. The sheet conveyor device includes a judgement section and a speed determining section. The judgement section determines which of a plurality of model groups the image forming apparatus belongs to based on specification information indicating specifications of the image forming apparatus. The speed determining section determines a conveyance speed at which the sheet is to be conveyed based on the determined model group.

BRIEF DESCRIPTION OF THE DRAWINGS

FIG. 4 is a diagram illustrating an example of specification information stored by a controller of the sheet conveyor device.

DETAILED DESCRIPTION

Figure 1:
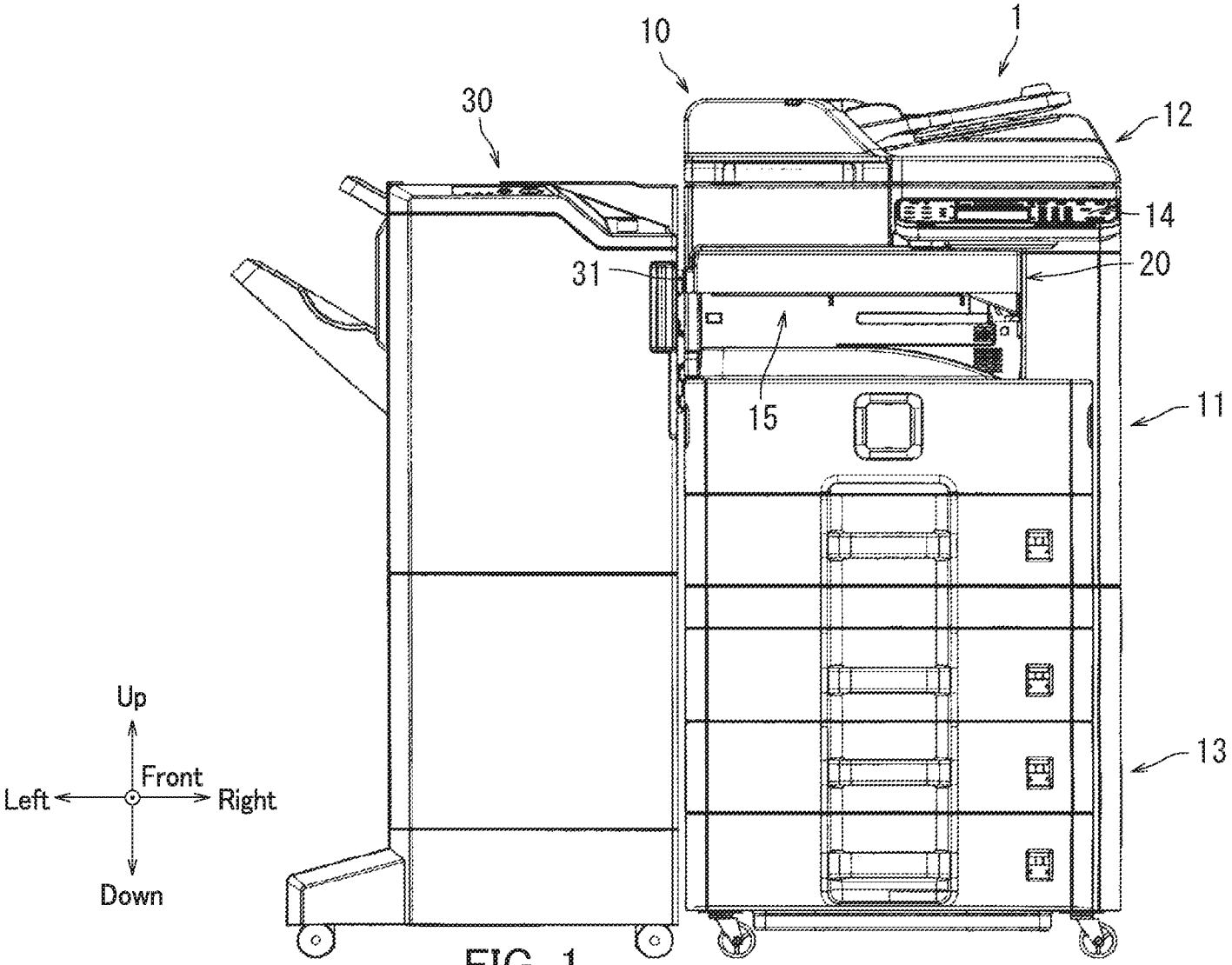
FIG. 1 is a front view of an outer appearance of an example of an image forming system according to an embodiment of the present disclosure.

The following describes an embodiment of the present disclosure with reference to the accompanying drawings (FIGS. 1 to 5). Elements that are the same or equivalent are labelled with the same reference signs in the drawings and description thereof is not repeated.

FIG. 1 is a front view of an outer appearance of an example of an image forming system 1 according to the embodiment of the present disclosure. The image forming system 1 includes an image forming apparatus 10, a sheet conveyor device 20, and a post-processing device 30.

The image forming apparatus 10 forms an image on a sheet (recording medium), and is a multifunction peripheral (MFP) for example. The image forming apparatus 10 includes a substantially rectangular parallelepiped main body housing 11, a document feeding device 12, an additional feeding unit 13, an operation section 14, and an in-body discharge section 15. The document feeding device 12 is located above the main body housing 11. The additional feeding unit 13 is mounted beneath the main body housing 11. The operation section 14 is located on an upper portion of the main body housing 11. The in-body discharge section 15 is located inside the upper portion of the main body housing 11. The sheet conveyor device 20 is attachably and detachably mounted to the in-body discharge section 15. The image forming apparatus 10 is an example of an external apparatus.

The main body housing 11 is a casing, and houses various equipment for forming an image on a sheet.

The document feeding device 12 automatically conveys a document to be copied by way of an image reading position. The image reading position is set above the main body housing 11.

The additional feeding unit 13 is added to automatically feed a large number of same-sized sheets in a situation in which various sheets of different sizes are automatically fed.

The operation section 14 notifies a user of various information and receives user instructions related to control of the image forming system 1. The operation section 14 is for example a liquid-crystal display with a touch panel.

The image forming apparatus 10 includes the in-body discharge section 15. The in-body discharge section 15 ejects a sheet with an image formed thereon. The in-body discharge section 15 has an in-body space capable of housing the sheet after image forming process has been performed. Specifically, the in-body discharge section 15 has an opening that is open towards the outside of the image forming apparatus 10 on front and left sides of the image forming apparatus 10. The user can reach into the opening to remove the sheet from the in-body discharge section 15 after the image has been formed in a state in which the sheet conveyor device 20 is not mounted to the image forming apparatus 10. The sheet conveyor device 20 is attachably and detachably mounted in the in-body discharge section 15. The in-body discharge section 15 is an example of a paper ejection section. The in-body space is an example of an empty space.

The sheet conveyor device 20 receives the sheet ejected from the image forming apparatus 10 and conveys the sheet to the post-processing device 30. The sheet conveyor device 20 is attachably and detachably mounted in the in-body discharge section 15 of the image forming apparatus 10. The sheet conveyor device 20 determines the conveyance speed when conveying the sheet according to specification information indicating the specifications of the image forming apparatus 10.

The post-processing device 30 receives the sheet conveyed by the sheet conveyor device 20 and performs prescribed post-processing on the sheet. The prescribed post-processing is punching and stapling, for example. The post-processing device 30 has a reception port 31 on a right side thereof. The reception port 31 receives the sheet from the sheet conveyor device 20.

In the following, a side on which the additional feeding unit 13 is located is referred to as a lower side of the image forming apparatus 10, and a side on which the document feeding device 12 is located is referred to as an upper side of the image forming apparatus 10. A side on which the operation section 14 is located is referred to as a front side of the image forming apparatus 10, and a side opposite to the front side is referred to as a back side of the image forming apparatus 10. A right side as viewed from the front of the image forming apparatus 10 is referred to as a right side of the image forming apparatus 10, and a side opposite to the right side is referred to as a left side of the image forming apparatus 10. The surface of the front side of the image forming apparatus 10 is referred to as a from surface, and the surface of the back side of the image forming apparatus 10 is referred to as a back surface.

Figure 2:
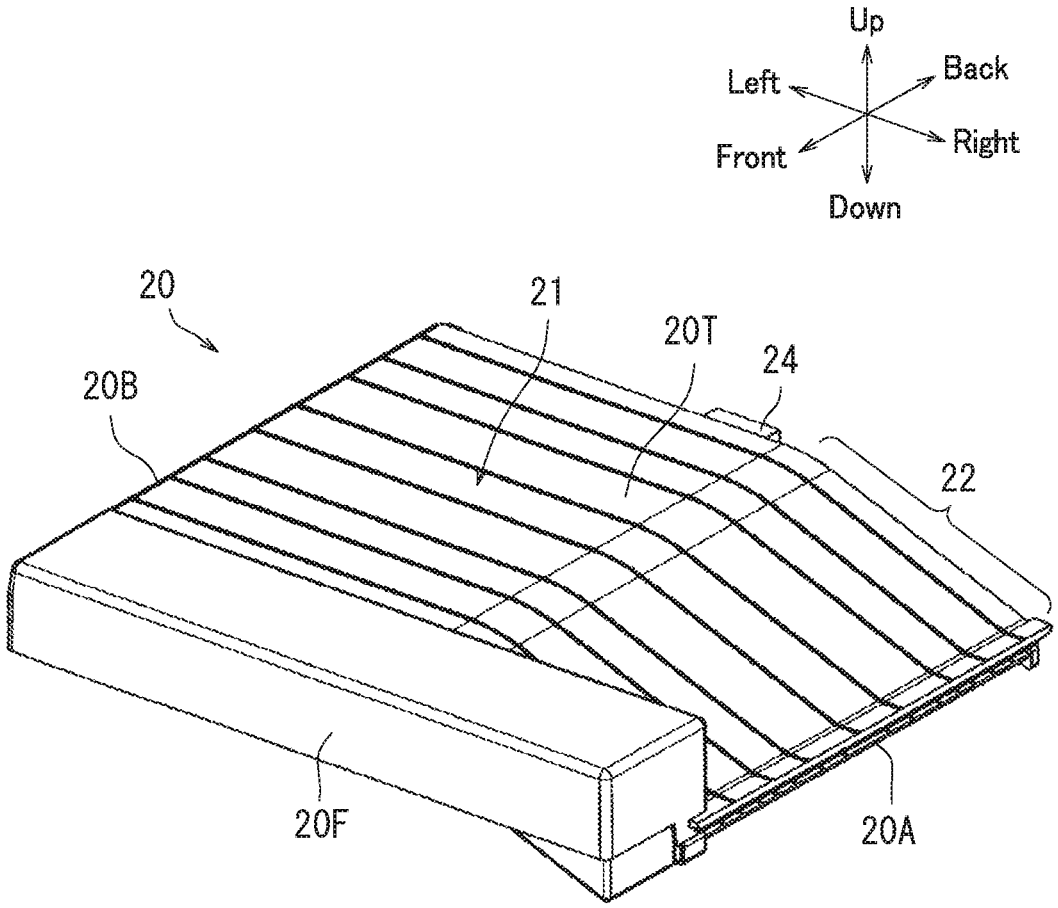
FIG. 2 is a perspective view of an outer appearance of an example of a sheet conveyor device.

The following describes an outer appearance of the sheet conveyor device 20 with reference to FIG. 2. FIG. 2 is a perspective view of the outer appearance of an example of the sheet conveyor device 20.

As illustrated in FIG. 2, the sheet conveyor device 20 is a housing that has a rectangular shape elongated in a general left-right direction when viewed from above, and maintains a prescribed thickness in an up-and-down direction. In detail, the sheet conveyor device 20 includes a main body portion 21 and an introduction portion 22. The main body portion 21 has a substantially rectangular parallelepiped shape. The introduction portion 22 is located to the right of the main body portion 21, and is inclined in a lower right direction.

The sheet conveyor device 20 further includes an upstream end 20A, a downstream end 20B, a front cover 20F, and a reception tray 20T. The upstream end 20A receives the sheet from the image forming apparatus 10. At the downstream end 20B, the sheet is ejected out (to the post-processing device 30, for example) from the sheet conveyor device 20.

The front cover 20F doubles as a cosmetic plate, and has a rectangular parallelepiped shape elongated in the left-right direction. The front cover 20F extends along an entire length of the sheet conveyor device 20 in the left-right direction. The reception tray 20T receives a sheet ejected from a second exit port 114. A height of an upper surface of the front cover 20F is higher than a height of the reception tray 20T above the main body portion 21. Accordingly, the reception tray 20T is covered by the front cover 20F and is not seen when viewed from the front.

The sheet conveyor device 20 further includes a connector 24. A connector joined with the connector 24 is included in a rear surface plate of the image forming apparatus 10. An electric line is electrically connected to a power supply or a controller of the image forming apparatus 10 through the connector 24. The electric line is for supplying power to or communicating with a plurality of drive motors which drives a plurality of feed roller pairs of the sheet conveyor device 20.

Figure 3:
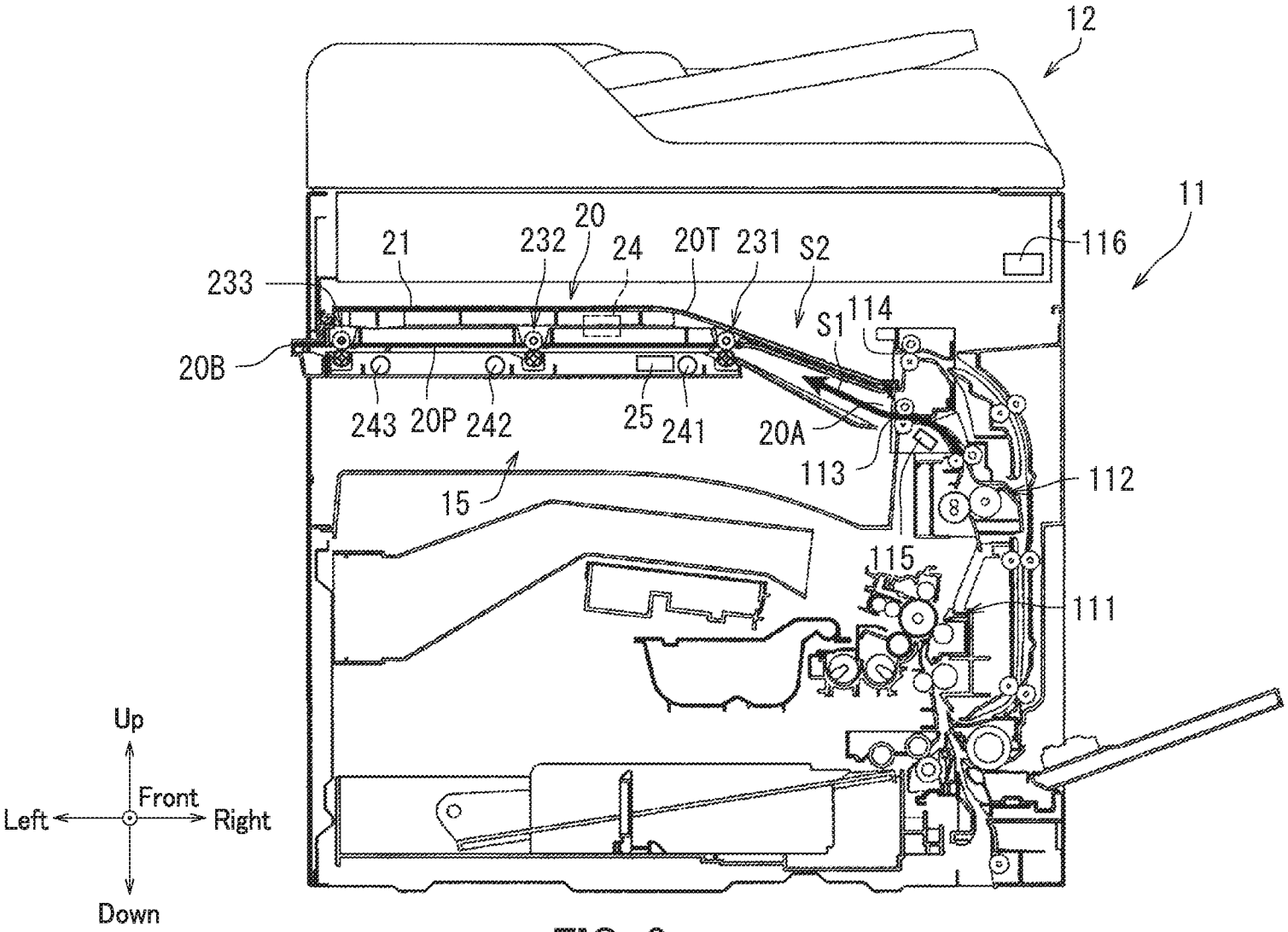
FIG. 3 is a diagram for describing operation related to the sheet conveyor device and a configuration of the sheet conveyor device.

The following describes operation related to the sheet conveyor device 20 and a configuration of the sheet conveyor device 20 with reference to FIG. 3. FIG. 3 is a diagram for describing operation related to the sheet conveyor device 20 and the configuration of the sheet conveyor device 20. First, operation of the image forming apparatus 10 which premises the operation of the sheet conveyor device 20 is described. The image forming apparatus 10 conveys the sheet with an image formed thereon to the position of the sheet conveyor device 20.

As illustrated in FIG. 3, the image forming apparatus 10 further includes an image forming section 111, a fixing section 112, a first exit port 113, the second exit port 114, a sheet sensor 115, and a controller 116. The image forming section 111, the fixing section 112, the first exit port 113, the second exit port 114, the sheet sensor 115, and the controller 116 are housed inside the main body housing 11. The in-body discharge section 15 is also included inside the main body housing 11.

The image forming section 111 forms an image on the sheet based on a user instruction received through the operation section 14 or print data received from a device such as a terminal device capable of using the image forming apparatus 10. Specifically, the image forming section 111 transfers a toner image from a photosensitive drum to the sheet. The sheet to which the image has been transferred is conveyed to the fixing section 112.

The fixing section 112 performs a fixing process on the sheet to which the image has been transferred. Specifically, the fixing section 112 performs a fixing process on the sheet by applying heat and pressure to the sheet to which the toner image has been transferred. The sheet on which the fixing process has been performed is ejected to the in-body discharge section 15 from the first exit port 113 or the second exit port 114.

The sheet sensor 115 detects whether or not the sheet has passed through the fixing section 112. The sheet sensor 115 notifies the controller 116 of a signal indicating detection of the sheet for example during a period starting when a leading edge of the sheet is detected and ending when a trailing end of the sheet exits. The sheet sensor 115 may also notify the controller 116 only of a signal indicating detection of the leading edge of the sheet and detection of the trailing edge of the sheet. The sheet sensor 115 is located downstream of the fixing section 112 in a conveyance direction of the sheet.

The controller 116 controls overall operation of the image forming apparatus 10. The controller 116 includes a processor and memory, for example. The processor includes a central processing unit (CPU), for example. The memory stores data and a computer program therein. The memory for example includes semiconductor memory, and may further include a hard disk drive (HDD).

The controller 116 stores the specification information of the image forming apparatus 10. The specification information includes at least one of identification information, linear speed information, and performance information. The specification information may for example be extracted from backup data acquired regularly or irregularly. The backup data includes at least one of the identification information, the linear speed information, and the performance information.

The identification information is information for identifying the image forming apparatus 10. The identification information is for example machine code of the image forming apparatus 10.

The performance information indicates a number of sheets that are printable by the image forming apparatus 10 per unit time. The performance information indicates 60 [sheets/minute], for example.

The linear speed information indicates linear speed when an image is formed in the image forming apparatus 10. The linear speed information indicates 300 [mm/s], for example. The linear speed information may be stored in association with the performance information. For example, the linear speed information may be stored so as to indicate 300 [mm/s] when the performance information indicates 60 [sheets/minute].

The controller 116 transmits the specification information to the sheet conveyor device 20 according to a request from the sheet conveyor device 20. Specifically, the controller 116 transmits the specification information to the sheet conveyor device 20 through the connector 24 of the sheet conveyor device 20 connected to the connector of the image forming apparatus 10.

The controller 116 transmits information related to the sheet to the sheet conveyor device 20 based on the data notified of from the sheet sensor 115. Specifically, the controller 116 notifies the sheet conveyor device 20 of information indicating detection of the leading edge of the sheet and detection of the trailing edge of the sheet.

The following describes the operation of the sheet conveyor device 20 with reference to FIG. 3. As illustrated in FIG. 3, the sheet conveyor device 20 includes a conveyance section 20P, the connector 24, and a controller 25. The conveyance section 20P includes at least two pairs of conveyance rollers and at least two drive motors. Specifically, the conveyance section 20P has a first roller pair 231, a second roller pair 232, a third roller pair 233, a first motor 241, a second motor 242, and a third motor 243.

The conveyance section 20P conveys a sheet received through the first exit port 113 (in a path indicated by an arrow S1) of the image forming apparatus 10 such that the sheet passes through the inside of the sheet conveyor device 20.

Each drive motor drives only one pair of conveyance rollers among the conveyance rollers. For example, the first roller pair 231 has a conveyance roller and a driven roller. The conveyance roller of the first roller pair 231 is driven by the first motor 241. Similarly, the second roller pair 232 and the third roller pair 233 each include a conveyance roller and a driven roller. The conveyance roller of the second roller pair 232 is driven by the second motor 242. The conveyance roller of the third roller pair 233 is driven by the third motor 243.

Each conveyance roller is provided with a limiting mechanism which allows rotation only in a rotational direction by which the sheet is conveyed in the prescribed conveyance direction. For example, each conveyance roller may include a one-way clutch.

The first motor 241 drives the conveyance roller of the first roller pair 231 according to an instruction of the controller 25. The second motor 242 drives the conveyance roller of the second roller pair 232 according to an instruction of the controller 25. The third motor 243 drives the conveyance roller of the third roller pair 233 according to an instruction of the controller 25. The first motor 241, the second motor 242, and the third motor 243 are stepper motors, for example.

The connector 24 electrically connects the power supply or the controller 116 of the image forming apparatus 10 to a power supply or the controller 25 of the sheet conveyor device 20 through the connector of the image forming apparatus 10.

The controller 25 controls operation of each section of the sheet conveyor device 20. The controller 25 includes a processor and memory, for example. The processor includes a CPU, for example. The memory stores data and a computer program therein. The memory for example includes semiconductor memory, and may further include a solid-state drive (SSD). The controller 25 receives a start signal indicating a start of a copy job or a print job from the image forming apparatus 10 through the connector 24. When receiving the start signal, the controller 25 may control the conveyance section 20P such that the conveyance speed of the sheet conveyor device 20 is the same speed as a linear speed (V0) of the image forming apparatus 10. The controller 25 is an example of a judgement section, a speed determining section, or a conveyance controller. The connector 24 and the controller 25 are an example of an information acquiring section.

The controller 25 determines which of a plurality of image forming apparatus model groups the image forming apparatus 10 belongs to based on the specification information indicating the specifications of the image forming apparatus 10. The controller 25 also determines the conveyance speed at which the sheet is to be conveyed inside the conveyance section 20P based on the determined model group.

The controller 25 also controls the first motor 241, the second motor 242, and the third motor 243 so as to convey the sheet at the determined conveyance speed.

The controller 25 acquires the specification information of the image forming apparatus 10 from the image forming apparatus 10 through the connector 24.

The controller 25 then determines the model group to which the image forming apparatus 10 belongs based on the identification information, the linear speed information, or the performance information. The controller 25 also determines the conveyance speed of the sheet conveyor device 20 based on the determined model group.

Specifically, the controller 25 determines whether the image forming apparatus 10 belongs to a high-end model group or a low-end model group based on the identification information, the linear speed information, or the performance information. The controller 25 then determines the conveyance speed of the sheet conveyor device 20 to be a first speed in a case where the image forming apparatus 10 belongs to the high-end model group. The controller 25 determines the conveyance speed of the sheet conveyor device 20 to be a second speed in a case where the image forming apparatus 10 belongs to the low-end model group.

The controller 25 may determine the conveyance speed at a specific timing. The controller 25 may determine the conveyance speed at a timing at which pass-through data is received from the image forming apparatus 10. The pass-through data indicates that the sheet has passed through the fixing section 112 of the image forming apparatus 10.

The controller 25 can receive classification data indicating a classification of the sheet from the image forming apparatus 10 through the connector 24. The controller 25 may then determine the conveyance speed based on the received classification data of the sheet. When the size of the sheet is long in the conveyance direction for example, a case may occur in which the leading edge of the sheet has mostly passed through the sheet conveyor device 20 when the trailing edge of the sheet exits the fixing section 112 of the image forming apparatus 10. In this case, the controller 25 can determine not to change a conveyance speed.

The following describes specification information stored in the controller 25 of the sheet conveyor device 20 with reference to FIG. 4. FIG. 4 is a diagram illustrating an example of the specification information stored in the controller 25 of the sheet conveyor device 20.

As illustrated in FIG. 4, a specification information table 400 exhibits each type of specification information in association with image forming apparatuses forming a model group. The specification information table 400 has a model group column 401, a sheet size column 402, a printing capability column 403, a linear speed column 404, and a conveyance speed column 405.

Information indicating the model group is included in the model group column 401. Information indicating the model group indicates a "high-end model" or a "low-end model", for example.

Information indicating the shape of the sheet is included in the sheet size column 402. The information indicating the size of the sheet indicates A3, B4, A4, B5, and postcard, for example.

Information indicating a printing capability of the image forming apparatuses is included in the printing capability column 403. The information indicating the printing capability indicates 40 to 60 [sheets/minute] for the high-end model and 25 to 32 [sheets/minute] for the low-end model, for example.

Information indicating the linear speed of the image forming apparatuses is included in the linear speed column 404, The information indicating the linear speed indicates 200 to 300 [mm/s] for the high-end model and 125 to 160 [mm/s] for the low-end model, for example.

Information indicating the conveyance speed corresponding to each model group is included in the conveyance speed column 405. The information indicating the conveyance speed corresponding to each model group indicates that a conveyance speed (V1) of the high-end model is 600 [mm/s] and a conveyance speed (V2) of the low-end model is 300 [mm/s], for example.

The controller 25 compares the specification information acquired from the image forming apparatus 10 to the specification information in the specification information table 400 stored in the controller 25 to determine whether the image forming apparatus 10 belongs to the high-end model group or the low-end model group.

Figure 5:
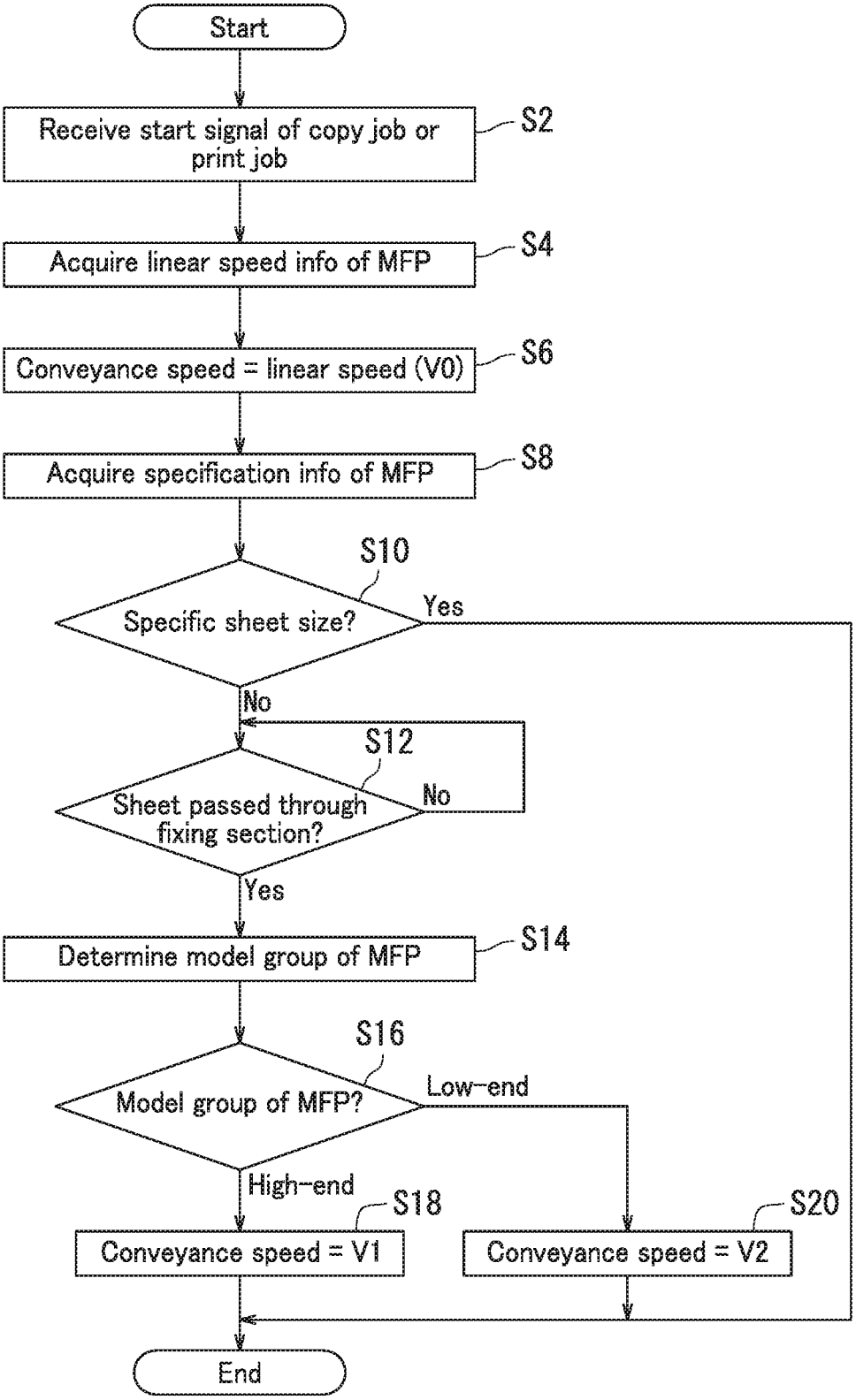
FIG. 5 is a flowchart depicting an example of a conveyance control process of the sheet conveyor device.

The following describes a conveyance control process with reference to FIGS. 1 to 5. FIG. 5 is a flowchart depicting an example of the conveyance control process of the sheet conveyor device 20. Herein, the "conveyance control process" is a process by which the controller 25 of the sheet conveyor device 20 determines the conveyance speed. Specifically, the controller 25 determines the conveyance speed based on the specification information acquired from the image forming apparatus 10. The conveyance control process is performed according to Steps S2 to S20.

Step S2: The controller 25 receives the start signal indicating a start of a copy job or a print job from the image forming apparatus 10 through the connector 24. The process advances to Step S4.

Step S4: The controller 25 acquires the linear speed information including the linear speed (V0) for the image forming apparatus 10 to perform the copy job or the print job. The process advances to Step S6.

Step S6: The controller 25 sets the conveyance speed of the sheet conveyor device 20 to the same speed as the linear speed (V0). The process advances to Step S8.

Step S8: The controller 25 acquires the specification information from the image forming apparatus 10. The process advances to Step S10.

Step S10: The controller 25 determines whether or not the size of the sheet with an image formed thereon through the copy job or the print job is a specific size. When the controller 25 determines that the size of the sheet is not the specific size (No in Step S10), the process advances to Step S12. When the controller 25 determines that the size of the sheet is the specific size (Yes in Step S10), the controller 25 ends the conveyance control process.

Step S12: The controller 25 determines whether or not the pass-through data indicating that the sheet has passed through the fixing section 112 has been received from the image forming apparatus 10. When the controller 25 determines that the pass-through data has been received (Yes in Step S12), the process advances to Step S14. When the controller 25 determines that the pass-through data has not been received (No in Step S10), the controller 25 enters standby until the pass-through data is received.

Step S14: The controller 25 determines the model group of the image forming apparatus 10 based on the acquired specification information. The process advances to Step S16.

Step S16: When the controller 25 determines the model group of the image forming apparatus 10 to be the high-end model group (high-end in Step S16), the process advances to Step S18. When the controller 25 determines the model group of the image forming apparatus 10 to be the low-end model group (low-end in Step S16), the process advances to Step S20.

Step S18: The controller 25 changes the conveyance speed of the sheet conveyor device 20 to V1 (V1>V0). The controller 25 ends the conveyance control process.

Step S20: The controller 25 changes the conveyance speed of the sheet conveyor device 20 to V2>V0). The controller 25 ends the conveyance control process.

As described above with reference to FIGS. 1 to 5, the sheet conveyor device mounted to the image forming apparatus determines the conveyance speed at which the sheet is to be conveyed based on the specification information of the image forming apparatus. Therefore, the sheet conveyor device can shorten a first copy time or a first print time while finely addressing the printing conditions of the image forming apparatus. A first copy time is for example a period starting when a starting instruction of a copy job is given and ending when a first sheet is ejected. A first print time is for example a period starting when a starting instruction of a print job is given and ending when a first sheet is ejected.

The embodiment of the present disclosure is described so far with reference to the accompanying drawings. However, the present disclosure is not limited to the above embodiment and may be implemented in various manners within a scope not departing from the gist thereof. Furthermore, various disclosures may be created by appropriately combining the elements of configuration disclosed in the above embodiment. For example, some of the elements of configuration in the embodiment may be omitted. Additionally, elements of configuration in different embodiments may be appropriately combined. The drawings illustrate main elements of configuration schematically to facilitate understanding thereof. Aspects of the elements of configuration in the drawings, such as thickness, length, number, and interval thereof, may differ in practice for the sake of convenience for drawing preparation. Furthermore, aspects of the elements of configuration described in the above embodiment such as material, shape, and dimension thereof are merely examples and not particular limitations. The elements of configuration may be variously altered within a scope not substantially departing from the effects of the present disclosure.

What is claimed is:

1. A sheet conveyor device to be attachably and detachably mounted to an external apparatus which forms an image on a sheet, the sheet conveyor device comprising:

a judgement section configured to determine which of a plurality of model groups the external apparatus belongs to based on specification information indicating specifications of the external apparatus; and a speed determining section configured to determine a conveyance speed at which the sheet is to be conveyed based on the determined model group.

2. The sheet conveyor device according to claim 1, further comprising:

a conveyance section configured to convey the sheet; and a conveyance controller configured to control the conveyance section to convey the sheet at the conveyance speed.

3. The sheet conveyor device according to claim 1, further comprising an information acquiring section configured to acquire the specification information, wherein the judgement section determines the model group to which the external apparatus belongs based on the acquired specification information.

4. The sheet conveyor device according to claim 3, wherein the specification information includes at least one of identification information, performance information, and linear speed information, the identification information is information for identifying the external apparatus, the performance information is information indicating a number of sheets that are printable by the external apparatus per unit time, the linear speed information is information indicating a linear speed when an image is formed in the external apparatus, the judgement section determines the model group to which the external apparatus belongs based on the identification information, the linear speed information, or the performance information, and the speed determining section determines the conveyance speed based on the determined model group.

5. The sheet conveyor device according to claim 4, wherein the judgement section determines whether the external apparatus belongs to a high-end model group or a low-end model group based on the identification information, the linear speed information, or the performance information, and the speed determining section determines the conveyance speed to be a first speed when the external apparatus belongs to the high-end group and determines the conveyance speed to be a second speed when the external apparatus belongs to the low-end group.

6. The sheet conveyor device according to claim 3, wherein the conveyance section includes at least two pairs of conveyance rollers and at least two drive motors, and each of the drive motors drives only one pair of conveyance rollers among the conveyance rollers.

7. The sheet conveyor device according to claim 6, wherein each of the conveyance rollers is provided with a limiting mechanism which allows rotation only in a rotational direction by which the sheet is conveyed in a prescribed conveyance direction.

8. The sheet conveyor device according to claim 7, wherein the limiting mechanism includes a one-way clutch.

9. The sheet conveyor device according to claim 3, wherein the information acquiring section receives pass-through data from the external apparatus, the pass-through data indicating that the sheet has passed through a fixing section of the external apparatus, and the conveyance controller controls the conveyance section to convey the sheet at the determined conveyance speed after the pass-through data has been received.

10. The sheet conveyor device according to claim 9, wherein the information acquiring section receives classification data from the external apparatus, the classification data indicating a classification of the sheet, and the speed determining section determines the conveyance speed based on the received classification data.

11. An image forming system comprising an image forming apparatus and a sheet conveyor device, wherein the image forming apparatus includes:

an image forming section configured to form an image on a sheet; and a paper ejection section including an empty space in which the sheet with the image formed thereon is housable, the empty space is open towards an outside of the image forming apparatus, the sheet conveyor device is mounted to the paper ejection section, and the sheet conveyor device includes:

a judgement section configured to determine which of a plurality of model groups the image forming apparatus belongs to based on specification information indicating specifications of the image forming apparatus; and a speed determining section configured to determine a conveyance speed at which the sheet is to be conveyed based on the determined model group.

* * * * *